US008141747B2

(12) United States Patent
Kim et al.

(10) Patent No.: US 8,141,747 B2
(45) Date of Patent: Mar. 27, 2012

(54) DISPENSER RELATED TECHNOLOGY

(75) Inventors: Seong Jae Kim, Seoul (KR); Nam Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 926 days.

(21) Appl. No.: 12/166,798

(22) Filed: Jul. 2, 2008

(65) Prior Publication Data

US 2009/0007585 A1 Jan. 8, 2009

(30) Foreign Application Priority Data

Jul. 6, 2007 (KR) ..... 10-2007-0068159

(51) Int. Cl.
*B67D 7/12* (2010.01)

(52) U.S. Cl. ..... 222/182; 222/146.6; 62/389

(58) Field of Classification Search ..... 222/530–538, 222/146.1, 146.6, 182, 52, 63; 62/389–400, 62/66, 459, 98
See application file for complete search history.

(56) References Cited

U.S. PATENT DOCUMENTS

| | | | | |
|---|---|---|---|---|
| 2,512,395 | A * | 6/1950 | Sundberg | 222/182 |
| 3,537,132 | A * | 11/1970 | Alvarez | 62/266 |
| 3,537,273 | A * | 11/1970 | Alvarez | 62/266 |
| 3,572,053 | A * | 3/1971 | Jacobus et al. | 62/344 |
| 3,640,088 | A * | 2/1972 | Jacobus et al. | 62/320 |
| 4,209,999 | A * | 7/1980 | Falk et al. | 62/344 |
| 6,425,425 | B2 * | 7/2002 | Bianchi et al. | 141/362 |
| 6,497,343 | B1 | 12/2002 | Teetsel | |
| 7,958,742 | B2 * | 6/2011 | Park et al. | 62/389 |
| 8,006,502 | B2 * | 8/2011 | Kim et al. | 62/66 |
| 2004/0187516 | A1 | 9/2004 | Lee | |
| 2006/0201194 | A1 * | 9/2006 | Bowen et al. | 62/344 |
| 2007/0289669 | A1 * | 12/2007 | An et al. | 141/362 |
| 2008/0314065 | A1 * | 12/2008 | Kim | 62/389 |
| 2010/0038387 | A1 * | 2/2010 | Lee et al. | 222/559 |

FOREIGN PATENT DOCUMENTS

| | | |
|---|---|---|
| KR | 10-2004-0013820 | 2/2004 |
| KR | 10-2005-0028360 | 3/2005 |
| KR | 10-2005-0033296 | 4/2005 |
| KR | 10-2007-0066297 | 6/2007 |
| WO | 2007/063039 | 6/2007 |

OTHER PUBLICATIONS

International Search Report & Written Opinion issued in International Application No. PCT/KR2008/003895, mailed Jun. 26, 2009, 9 pages.

* cited by examiner

*Primary Examiner* — Kevin P Shaver
*Assistant Examiner* — Robert Nichols, II
(74) *Attorney, Agent, or Firm* — Fish & Richardson P.C.

(57) ABSTRACT

A food storage apparatus enables dispensation of contents (e.g., ice and/or water) stored in the food storage apparatus and collects residual contents after the dispensation of the contents.

21 Claims, 9 Drawing Sheets

DISPENSER RELATED TECHNOLOGY

CROSS REFERENCE TO RELATED APPLICATIONS

This application claims the benefit of Korean Patent Application No. 10-2007-0068159, filed on Jul. 6, 2007, which is hereby incorporated by reference for all purposes as if fully set forth herein.

FIELD

The present disclosure relates to dispenser technology.

BACKGROUND

A refrigerator is a representative food storing apparatus. Generally, a refrigerator includes a freezing compartment and a refrigerating compartment. The refrigerating compartment is kept at a temperature of about 3 to 4° C., to store food and vegetables in a fresh state for a prolonged period of time. The freezing compartment is kept at a temperature of below zero, to store meat and other food in a frozen state. A refrigerator may include an ice maker configured to make ice and a dispenser configured to dispense liquid water and ice made by the ice maker.

SUMMARY

In one aspect, an appliance includes a compartment, a door configured to open and close at least a portion of the compartment, and a dispenser that is positioned on a surface of the door and that is configured to dispense content through a dispenser outlet. The appliance also includes a button tray composite device that is configured to control the dispenser to dispense content and that is configured to receive residual content discharged out of the dispenser outlet after the dispenser dispenses content, and a guide unit that is configured to capture and guide residual content discharged out of the dispenser outlet to the button tray composite device such that the residual content is received and stored in the button tray composite device, the guide unit being positioned between the dispenser outlet and the button tray composite device and being structurally independent of at least the dispenser outlet.

Implementations may include one or more of the following features. For example, the guide unit may have a cross-sectional surface area that is larger than a cross-sectional surface area of the dispenser outlet. An end of the dispenser outlet may include an inner edge that defines an opening through which content discharged out of the dispenser outlet passes and an outer edge that defines an exterior of the end of the dispenser outlet. When the appliance is oriented in an ordinary operating position, the guide unit may be positioned beneath the opening defined by the inner edge of the end of the dispenser outlet and extends beyond at least a portion the outer edge of the end of the dispenser outlet.

In some implementations, the dispenser may include a water outlet configured to dispense liquid water, and an ice outlet that is configured to dispense ice and that is different than the water outlet. In these implementations, the guide unit may be configured to capture and guide residual content discharged out of the water outlet and the ice outlet.

The dispenser may include a moving chute that is configured to move between an operable position in which the moving chute is at least partially positioned on a side of the surface of the door opposite of the compartment, and a stored position in which the moving chute is positioned entirely on a side the surface of the door where the compartment is positioned, the moving chute having structure that defines at least a portion of a passage through which content is discharged from the appliance, and the button tray composite device may include a button tray defining a content receiving space for receiving and storing the residual content. The guide unit may include a first guide member that is disposed above the button tray when the appliance is oriented in an ordinary operating position, that is fixed to a frame of the door, and that is configured to guide the residual content to the button tray when the button tray is positioned entirely on a side the surface of the door where the compartment is positioned, and a second guide member that is configured to move with the moving chute relative to the first guide member and that is configured to guide residual content to the button tray when the button tray is in a position in which at least a portion of the button tray is positioned on the side of the door surface opposite of the compartment. The second guide member may be positioned to guide the residual content to the first guide member when the moving chute is positioned entirely on a side the surface of the door where the compartment is positioned.

In some examples, the button tray composite device may include a button switch configured to control the dispenser to dispense content, a button tray defining a content receiving space for receiving and storing the residual content, and a tray drive mechanism configured to move the button tray away from the door surface in the absence of force applied to the button tray in a direction that is toward the door surface, and to change a position of the button tray from a first position that is misaligned with the dispenser outlet in response to force that is applied to the button tray to a receiving position that is aligned with and captures content dispensed through the dispenser outlet in response to removal of force that is applied to promote positioning of the button tray in the first position the button tray, and the guide unit is configured to guide residual content to the button tray. In these examples, the appliance may include a dispensing switch that is positioned to contact the button switch in response to movement of the button, and that is configured to control dispenser to dispense content through the dispenser outlet in response to being contacted by the button switch.

The dispenser further may include a moving chute that is configured to move between an operable position in which the moving chute is at least partially positioned on a side of the door surface opposite of the compartment, and a stored position in which the moving chute is positioned entirely on a side the door surface where the compartment is positioned, where the moving chute has structure that defines at least a portion of a passage through which content is discharged from the appliance. The button tray of the button tray composite device may be configured to move to a position in which at least a portion of the button tray is positioned on the side of the door surface opposite of the compartment when the moving chute moves from the stored position to the operable position.

The dispenser may include a dispensing cover arranged further from the compartment than the moving chute, and a cover fixing unit that is configured to, when the moving chute is positioned in the operable position, prevent the dispensing cover from being moved by a force lower than a predetermined force, and to allow the moving chute to move from the operable position toward the stored position in response to a force higher than the predetermined force. The guide unit is attached to the moving chute or the dispensing cover.

In some implementations, the guide unit may be disposed above the button tray when the appliance is oriented in an ordinary operating position. In these implementations, the guide unit may include an inclined portion that is inclined toward the button tray. The inclined portion may be configured to capture residual content discharged from the dispenser outlet and guide the captured residual content to the button tray based on gravitational force. The guide unit also may be positioned on a side the surface of the door where the compartment is positioned.

In another aspect, an appliance includes a compartment, a door configured to open and close at least a portion of the compartment, and a dispenser that is positioned on a surface of the door and that is configured to dispense liquid water through a water outlet and to dispense ice through an ice outlet that is different than the water outlet. The appliance also includes a button tray configured to inspire at least one of liquid water and ice to be dispensed from the dispenser in response to being pushed and to, after release of force pushing the button tray to inspire at least one of liquid water and ice to be dispensed from the dispenser, receive and store residual liquid water and ice dispensed from the dispenser, a button switch attached to the button tray and configured to control the dispenser to dispense at least one of liquid water and ice in response to the button tray being pushed, and a guide unit that is configured to guide residual liquid water discharged out of the water outlet and residual ice discharged out of the ice outlet to the button tray such that the residual liquid water and ice is received and stored in the button tray.

Implementations may include one or more of the following features. For instance, the guide unit may have a cross-sectional surface area that is larger than a cross-sectional surface area of the water outlet. The guide unit may have a cross-sectional surface area that is larger than a cross-sectional surface area of the ice outlet.

The dispenser may include a moving chute that is configured to move between an operable position in which the moving chute is at least partially positioned on a side of the surface of the door opposite of the compartment, and a stored position in which the moving chute is positioned entirely on a side the surface of the door where the compartment is positioned, the moving chute having structure that defines at least a portion of a passage through which content is discharged from the appliance. The guide unit may include a first guide member that is disposed above the button tray when the appliance is oriented in an ordinary operating position, that is fixed to a frame of the door, and that is configured to guide the residual liquid water and ice to the button tray when the button tray is positioned entirely on a side the surface of the door where the compartment is positioned, and a second guide member that is configured to move with the moving chute relative to the first guide member and that is configured to guide residual liquid water and ice to the button tray when the button tray is in a position in which at least a portion of the button tray is positioned on the side of the door surface opposite of the compartment. The second guide member may be further configured to guide residual content to the first guide member when the moving chute is in the stored position.

In some examples, the dispenser may include a moving chute that is configured to move between an operable position in which the moving chute is at least partially positioned on a side of the door surface opposite of the compartment, and a stored position in which the moving chute is positioned entirely on a side the door surface where the compartment is positioned, the moving chute having structure that defines at least a portion of a passage through which content is discharged from the appliance. In these examples, the dispenser may include a dispensing cover arranged further from the compartment than the moving chute, and a cover fixing unit that is configured to, when the moving chute is positioned in the operable position, prevent the dispensing cover from being moved by a force lower than a predetermined force, and to allow the moving chute to move from the operable position toward the stored position in response to a force higher than the predetermined force.

The guide unit may be disposed above the button tray when the appliance is oriented in an ordinary operating position. The guide unit may include an inclined portion that is inclined toward the button tray. The inclined portion may be configured to capture residual content discharged from the water outlet and the ice outlet and guide the captured residual content to the button tray based on gravitational force.

DETAILED DESCRIPTION

Figure 1:
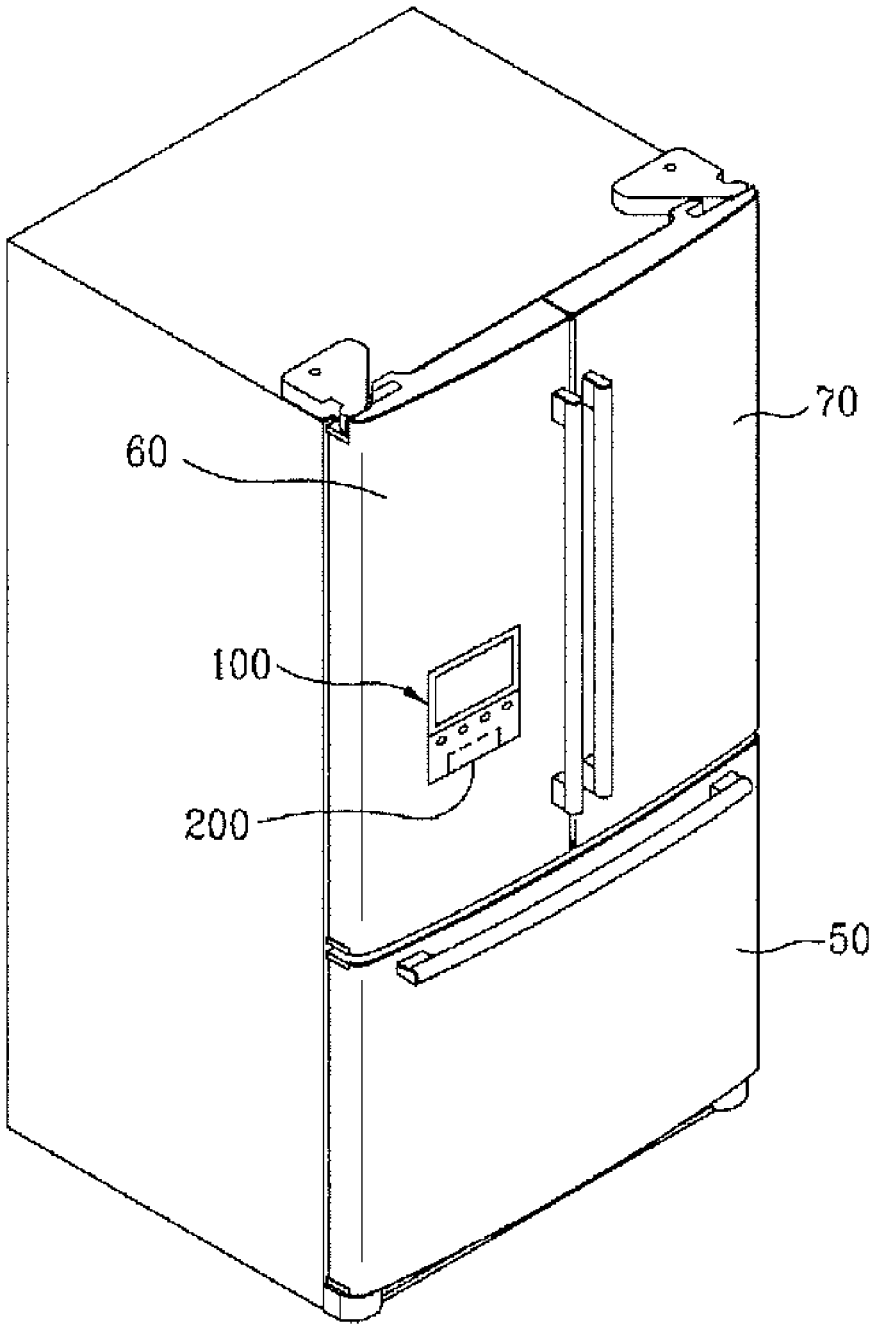
FIG. 1 is a perspective view illustrating a food storing apparatus.

FIG. 1 illustrates a food storing apparatus, such as a refrigerator. The refrigerator includes a freezing compartment configured to store food at a temperature below freezing and a refrigerating compartment configured to store food at a cool temperature that is higher than freezing. The refrigerator includes a freezing compartment door 50 arranged at a front side of the freezing compartment and configured to open and close the freezing compartment and refrigerating compartment doors 60 and 70 arranged at a front side of the refrigerating compartment and configured to open and close the refrigerating compartment. The freezing compartment is positioned beneath the refrigerating compartment when the refrigerator is oriented in a typical operating position. The refrigerating compartment may be divided into two blocks.

In implementations in which the refrigerating compartment is divided in two blocks, the refrigerating compartment includes a first refrigerating compartment and a second refrigerating compartment. In these implementations, the refrigerating compartment door 60 is a first refrigerating compartment door configured to open and close the first refrigerating compartment, whereas the refrigerating compartment door 70 is a second refrigerating compartment door configured to open and close the second refrigerating compartment. The first and second refrigerating compartment doors 60 and 70 are pivotally coupled to opposite side walls of a refrigerator body by hinges such that the doors 60 and 70 may be pivotally opened and closed. The freezing compartment door 50 is opened and closed in a sliding manner in forward and rearward directions of the refrigerator body.

The freezing and refrigerating compartment doors may be arranged at various positions in accordance with the positions of the freezing and refrigerating compartments. For example, the refrigerator may include various styles of refrigerators, for example, a refrigerator with a top mount freezing compartment and side-by-side style refrigerators that include side-by-side refrigerating and freezing compartments.

A dispenser 100 is located at a front side of the refrigerating compartment door 60, and configured to dispense certain content, such as, water or ice. A button tray composite device 200 is located beneath the dispenser 100, and configured to receive a residual content left in the dispenser 100 after dispensation of water or ice.

Figure 2:
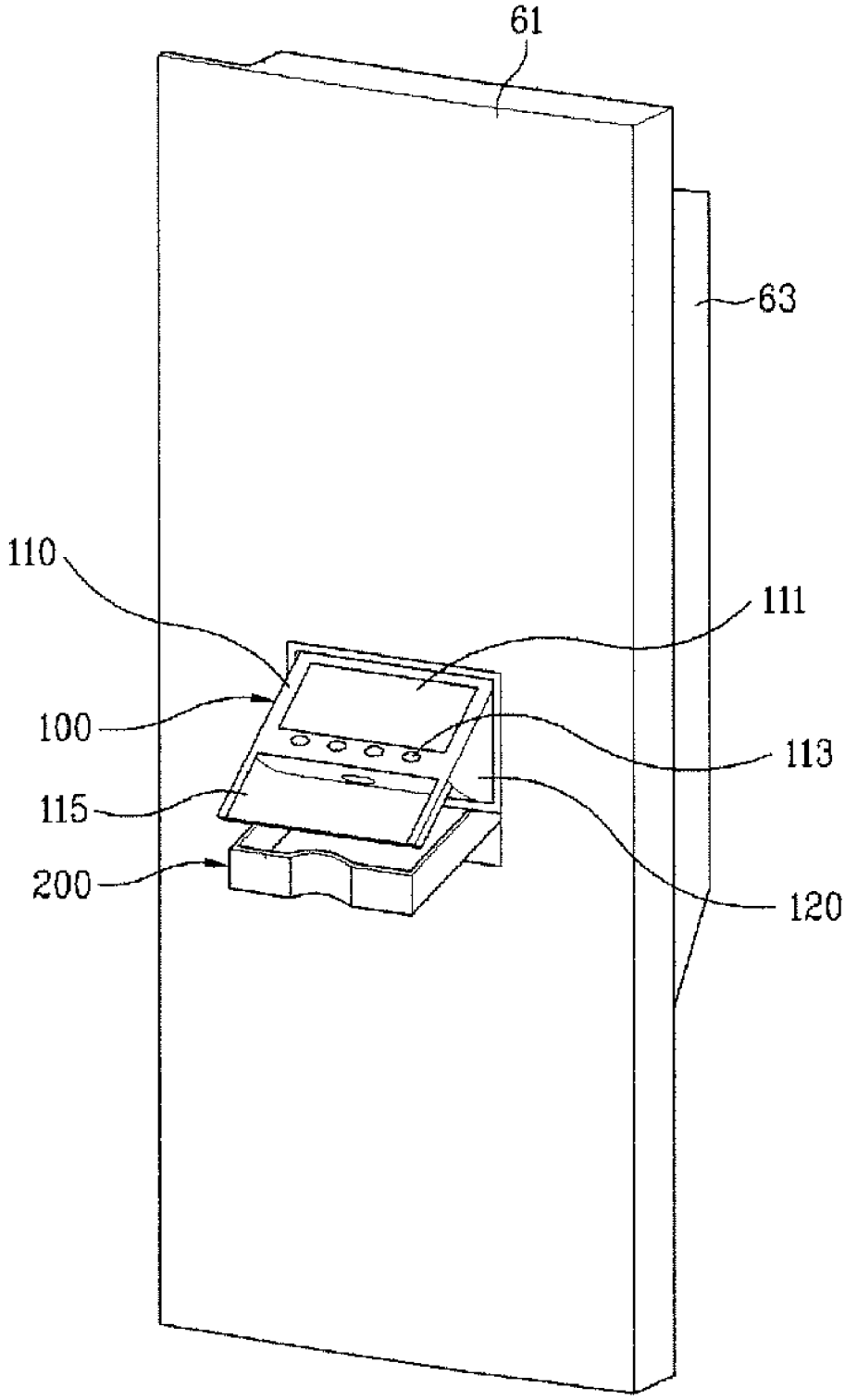
FIG. 2 is a perspective view of a part of the food storing apparatus of FIG. 1 corresponding to a front surface of a door, illustrating a state in which a dispenser included in the food storing apparatus is in an operable position.

FIG. 2 illustrates a part of the food storing apparatus of FIG. 1 corresponding to a front surface of a door. As shown in FIG. 2, the dispenser is in an operable position.

The first refrigerating compartment door 60 includes a front frame 61 and a rear frame 63. The front frame 61 is partially exposed to the outside of the refrigerator, whereas the rear frame 63 is partially exposed to the inside of the refrigerator body when the refrigerating compartment door 60 is in a closed position.

A space is defined between the front frame 61 and the rear frame 63. In the space, an ice maker (not shown), which produces ice, an ice storing container (not shown), which stores the ice produced by the ice maker, and a water tank, which stores water, are installed. In some examples, the ice maker, ice storing container, and water tank may be installed in the refrigerator body, or installed at the freezing compartment door 50.

The dispenser 100 is positioned on the door and at least a portion of the dispenser is configured to fit in the space defined between the front frame 61 and the rear frame 63 when the dispenser is in a stored position. The dispenser 100 also is connected to the water tank and ice storing container to receive water or ice for dispensing.

The dispenser 100 includes a moving chute 120 configured to move between a stored position and an operable position. In the operable position, at least a portion of the moving chute 120 is positioned outside of the front frame 61, and the moving chute 120 is configured to define a passage for discharging ice through the door. In the stored position, at least a portion of the moving chute 120 is positioned in the space defined between the front frame 61 and the rear frame 63. The dispenser 100 also includes a dispensing cover 110, which may be configured to move between a stored position and an operable position together with the moving chute 120. In the stored position, the dispensing cover 110 may be positioned flush with a surface of the door.

Control buttons 113 and a display 111 are arranged on the dispensing cover 110. The control buttons 113 control various dispenser and/or refrigerator functions. For instance, the control buttons 113 may control a selection of content for dispensing, for example, selection of ice or water. The display 111 displays a content dispensation state and any other information related to the dispenser 100 or the refrigerator.

A transparent panel 115 is positioned on the dispensing cover 110, to allow a user to visually check the button tray composite device at an outside of the refrigerator. Through the transparent panel 115, the user may visually check how much content discharged through an outlet included in the moving chute 120 is received in a container. The transparent panel 115 enables a user to view ice or water being dispensed into a container to ensure the container is positioned such that the ice or water being dispensed is received in the container and also to determine when to stop dispensing because the container has been filled to a desired level.

In some implementations, a separate illumination device may be installed in an inner space of the door. In these implementations, the illumination device may operate to emit light, only when content (e.g., ice or water) is being dispensed, in order to allow the user to check how much content is received in a container. Further, in these implementations, the dispensing cover 110 may be made of a material that allows light to pass through the dispensing cover 110.

As shown in FIG. 2, the dispensing cover 110 and moving chute 120 are structurally connected (e.g., integrated). For instance, the dispensing cover 110 and moving chute 120 constitute a single dispensing housing. The dispensing cover 110 defines an external appearance of the dispensing housing, whereas the moving chute 120 defines an interior of the dispensing housing. In these configurations, the dispensing cover 110 and moving chute 120 move together. In particular, the moving chute 120 moves to enter or exit the inner space of the door.

Figure 3:
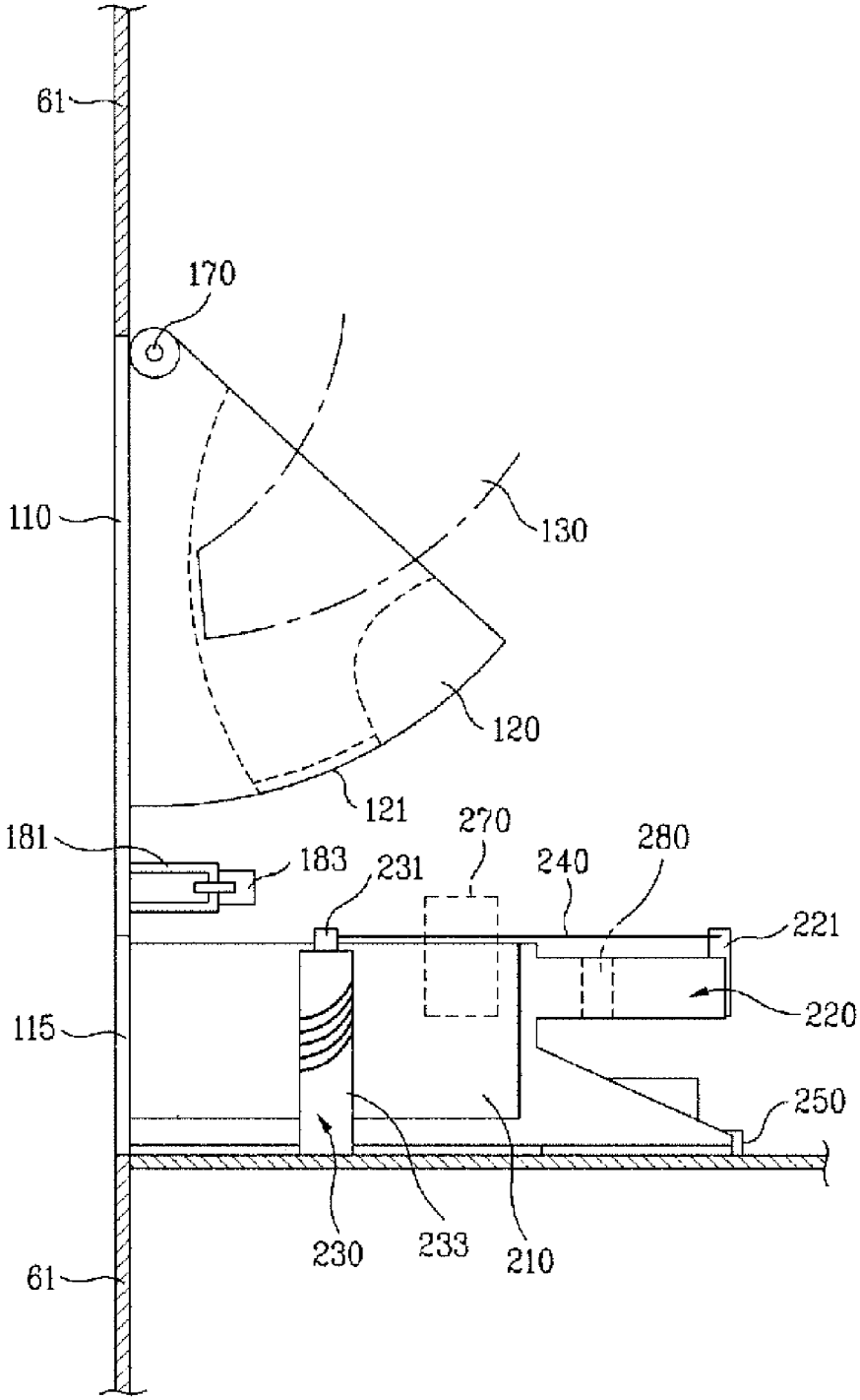
FIG. 3 is a sectional view illustrating a state in which a button tray composite device is in a stored position.
Figure 4:
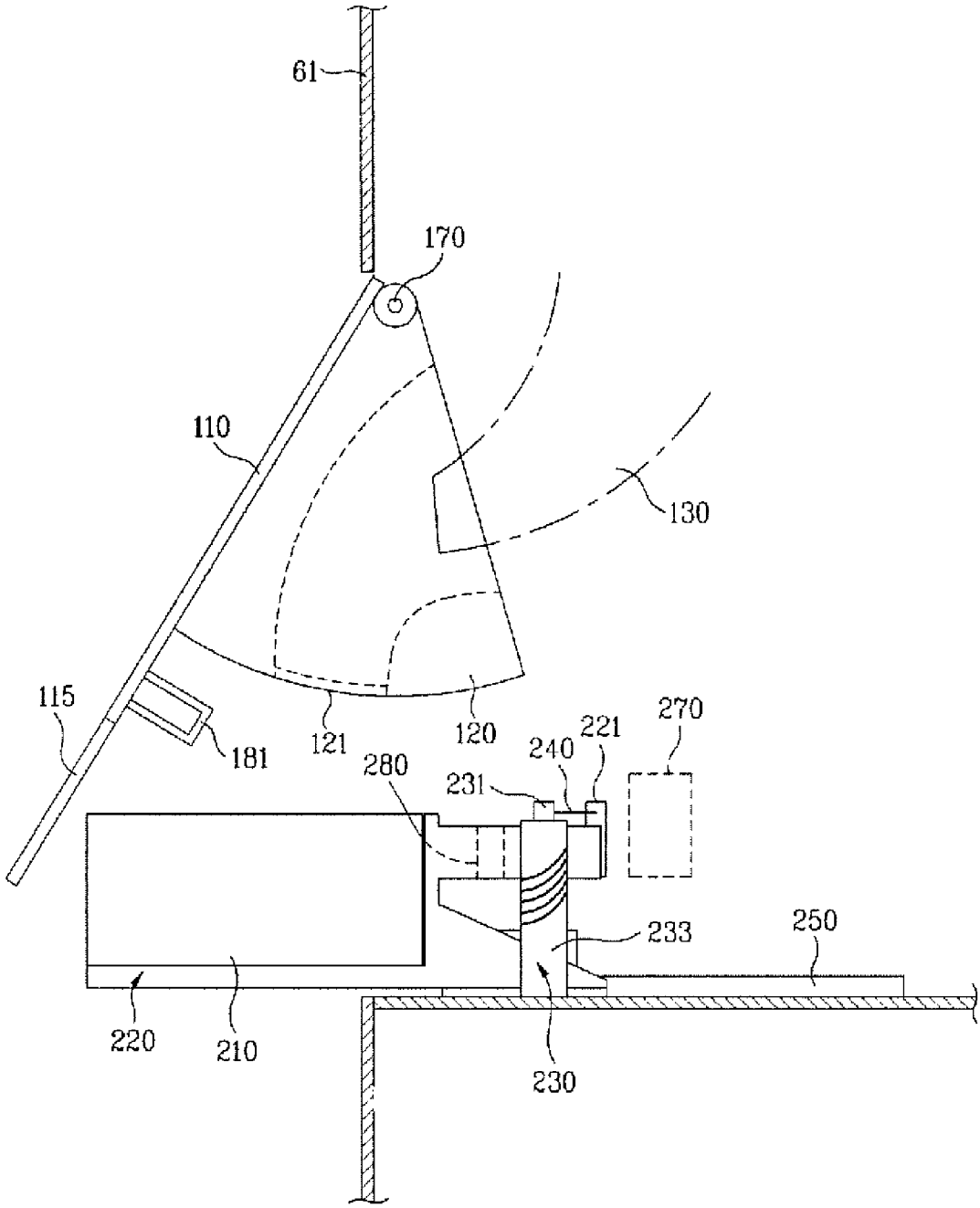
FIG. 4 is a sectional view illustrating a state in which a button tray composite device is in an operable position.

FIG. 3 illustrates a button tray composite device in a stored position and FIG. 4 illustrates a button tray composite device in an operable position. The dispenser 100 includes a fixed chute 130 having a first end that communicates with the moving chute 120, and a second end that communicates with the ice storing container, which stores ice. The fixed chute 130 is positioned in the space defined between the front frame 61 and the rear frame 63. The fixed chute 130 is fixed in the space by fasteners (not shown), for example, bolts and nuts, or hooks.

The moving chute 120 has a length enabling the moving chute 120 to communicate with the fixed chute 130 during movement of the moving chute 120, irrespective of whether the moving chute 120 is in an operable position outside of the front frame 61 or in a stored position in the inner space of the door defined between the front frame 61 and the rear frame 63.

An ice discharge duct (not shown) may be positioned in the space defined between the front frame 61 and the rear frame 63, to define an ice flow passage from the ice storing container to the fixed chute 130. A duct cover (not shown) may be located at an end of the ice discharge duct that communicates with the fixed chute 130, and configured to open and close the ice discharge duct.

A mechanical drive mechanism is provided at the refrigerating compartment door 60. The mechanical drive mechanism is configured to move the dispensing cover 110 and moving chute 120 from a stored position to an operable position in which the dispensing cover 110 and moving chute 120 are positioned outside of the front frame 61.

The mechanical drive mechanism includes a hinge 170 that allows the dispensing cover 110 connected to the moving chute 120 to pivot or rotate with respect to the front frame 61, and an elastic device (not shown) that provides an elastic force to the dispensing cover 110 and moving chute 120 to promote movement of the dispensing cover 110 and moving chute 120 from the stored position to the operable position in which the dispensing cover 110 and moving chute 120 are positioned outside of the front frame 61. The mechanical drive mechanism also includes a coupling unit that couples the dispensing cover 110 to the front frame 61 against the elastic force provided by the elastic device, thereby retaining the dispensing cover 110 and moving chute 120 in the stored position when the coupling unit is engaged.

The coupling unit includes a first coupler 181 mounted to the dispensing cover 110, and a second coupler 183 mounted in the inner space of the door. The first and second couplers 181 and 183 operate to be engaged or separated from each other, upon receiving a force from a user.

For example, when the first and second couplers 181 and 183 are simultaneously pressed, a coupling hook provided at the second coupler 183 is separated from a coupling groove provided at the first coupler 181. When the first coupler 181 is separated from the second coupler 183 and pressed, the coupling hook engages the coupling groove, thereby coupling the first coupler 181 to the second coupler 183.

The mechanical drive mechanism may further include a damper (not shown) for adjusting the speed of the dispensing cover during the movement of the dispensing cover 110. The damper may be any device configured to apply a constant force to the dispensing cover 110 and moving chute 120 such that the dispensing cover 110 and moving chute 120 pivot at a constant speed. For example, a gas spring or a gearing may be used, which may apply a relatively constant force to the dispensing cover 110 and moving chute 120 against the pivotal movement of the dispensing cover 110 and moving chute 120.

The hinge 170 includes hinge pins (not shown) respectively located at opposite ends of the dispensing cover 110, and hinge grooves (not shown) located at an inner surface of the front frame 61 such that the hinge grooves correspond to the hinge pins, respectively. Accordingly, the dispensing cover 110 and moving chute 120 pivot about the hinge pins.

The refrigerator further may include a water discharge duct (not shown) coupled to the dispensing cover 110, and configured to discharge water. When the dispensing cover 110 and moving chute 120 are in an operable position outside of the front frame 61 (e.g., in a water dispensing mode), the water discharge duct (not shown) coupled to the dispensing cover 110 is positioned together with the dispensing cover 110 and moving chute 120, so that water can be discharged out of an outlet of the water discharge duct outside of the front frame 61.

The button tray composite device 200, which is located beneath the dispenser 100, controls the dispensation of content (e.g., ice or water) discharged out of an outlet 121 of the moving chute 120. The button tray composite device 200 also is configured to receive a residual content discharged from the outlet 121 after the completion of a content dispensing operation.

A controller (not shown) is located at one side in the inner space of the door. The controller includes a dispensing switch 270 configured to control dispensation of content, in cooperation with the button tray composite device 200.

The button tray composite device 200 includes a button switch 280 that is selectively connectable to the dispensing switch 270 to control the dispensation of the content. The button tray composite device 200 also includes a button tray 210 having a content receiving space configured to receive content (e.g., residual content after a dispensing operation) from the outlet 121 when the button tray 210 is in an extended position corresponding to and positioned under the outlet 121. The button tray composite device 200 further includes a tray driving mechanism configured to move the button tray 210.

In addition, the button tray composite device 200 includes a guide member 250 configured to guide the movement of the button tray 210. A moving member 220, which may be selectively coupled to the button tray 210, is configured to move, together with the button tray 210, while being guided by the guide member 250.

Figure 5:
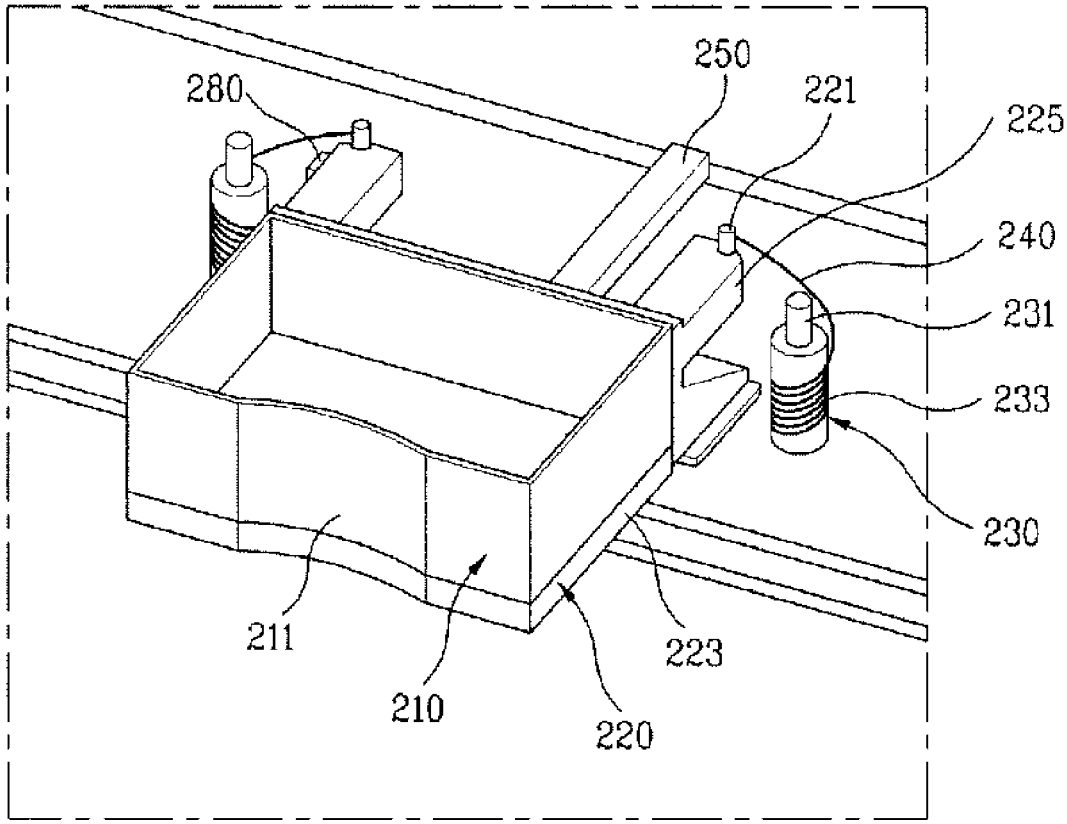
FIG. 5 is a perspective view illustrating a button tray composite device.
Figure 6:
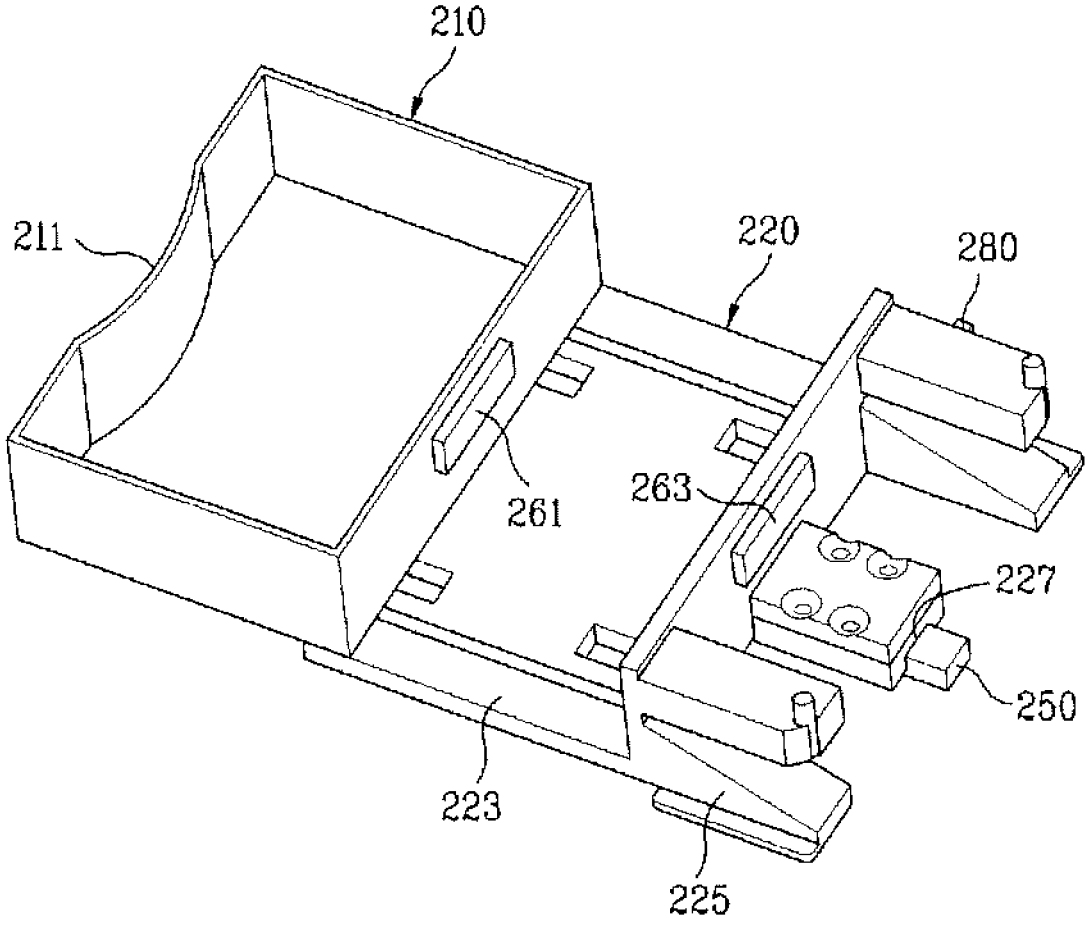
FIG. 6 is an exploded perspective view illustrating a button tray composite device.

FIG. 5 illustrates a button tray composite device and FIG. 6 is an exploded perspective view illustrating a button tray composite device. As shown, the button tray 210, which has the content receiving space configured to receive a residual content, also has a front panel having a curved portion 211 that allows the front panel to easily come into contact with a container to receive the dispensed content. The curved portion 211 defines a concave space in the button tray 210 that is shaped to accommodate a portion of a typical container such that the button tray may be effectively contacted with and thus actuated by a container.

The moving member 220 includes a bottom wall 223 that defines a bottom of the button tray 210, and supports the bottom of the button tray 210. A rear wall 225 is connected to (e.g., integrated with) the bottom wall 223, and supports the rear side of the button tray 210.

A guide groove 227 is defined (e.g., formed) in the bottom wall 223 of the moving member 220, at a lower surface thereof, and corresponds to the guide member 250. When the moving member 220 moves, the guide groove 227 of the moving member 220 slides along the guide member 250, thereby guiding the movement of the moving member 220.

The button tray 210 is coupled to the moving member 220 by a coupler. Accordingly, when an external force is applied to the button tray 210, the moving member 220 is moved, together with the button tray 210.

In some implementations, the coupler includes a first coupling member 261, which is mounted to a rear panel of the button tray 210, and has magnetic properties, and a second coupling member 263 mounted to the rear wall 225 of the moving member 220. The second coupling member 263 may be coupled to the first coupling member 261 by a magnetic force generated from the first coupling member 261. The first coupling member 261 may comprise a permanent magnet or an electromagnet, whereas the second coupling member 263 may comprise a permanent magnet, an electromagnet, or a metallic member.

In other examples, the coupling between the moving member 220 and the button tray 210 may be achieved using another coupling method that enables the moving member 220 and the button tray 210 to be coupled and uncoupled. For example, the moving member 220 and button tray 210 may be coupled by a hook coupling method or a thread coupling method.

The button switch 280 is mounted to the moving member 220 such that it is selectively connectable to the dispensing switch 270. For example, when the button switch 280 comes into contact with the dispensing switch 270 as the moving member 220 moves, the dispensing switch 270 generates a signal, and sends the generated signal to the controller. In response to the signal, the controller controls the dispensation of the contents (e.g., ice, water, etc.).

The tray drive mechanism includes an elastic member having an elastic resilience against an external force applied to the button tray 210. A wire spring may be used for the elastic member.

The tray drive mechanism includes a roller 230 installed at one side in the interior of the door, and a wire spring 240 wound around the roller 230. The wire spring 240 is unwound from the roller 230 when an external force is applied to the tray drive mechanism, and is wound around the roller 230 when the external force is released. When the wire spring 240 is wound around the roller 230, it applies a force that moves the button tray 210. As shown in FIG. 5, the tray drive mechanism includes a pair of rollers 230 installed at opposite sides in the interior of the door, and a pair of wire springs 240 wound around the rollers 230, respectively. Although the description focuses on a single roller 230 and a single wire spring 240, the described techniques may be applied when two or more rollers and wire springs are used.

The wire spring 240 is coupled, at one end thereof, to a spring support 221 provided at the moving member 220, and is coupled, at the other end thereof, to the roller 230. The roller 230 includes a rotating body 233, and a rotating shaft 231 that defines a rotating axis of the rotating body 233. The tray drive mechanism may further include a torsion spring (not shown) mounted to the roller 230, to return the rotating body 233 from a rotated state (e.g., a state in which the wire spring 240 is unwound) to an original state (e.g., a state in which the wire spring 240 is wound around the rotating body 233).

In accordance with the above-described configuration, when the button tray 210 moves in response to an external force applied thereto (e.g., a force applied by a user), the moving member 220 that is coupled to the button tray 210 moves together with the button tray 210. During movement of the moving member 220, the wire spring 240 coupled to the moving member 220 is made tense. Namely, a tension is applied to the wire spring 240, so that the wire spring 240 is gradually unwound from the roller 230 due to rotation of the roller 230 caused by the tension.

When the external force is subsequently released, the wire spring 240 is wound around the roller 230 by the resilience of the wire spring 240 or torsion spring. At this time, the moving member 220 coupled to the wire spring 240 moves to an original position where the moving member 220 was positioned before the application of the external force.

The elastic member that provides resilience to the tray may have any shape. For example, a spring having a structure different from the above-described structure, such as a coil spring or a plate spring, may be used for the elastic member.

In some implementations, the elastic member may be arranged such that one end thereof is coupled to the moving member, and the other end thereof is positioned in the inner space of the door. In these implementations, when the button tray 210 is pushed into the inner space of the door by an external force (e.g., a force applied by a user with a container), the elastic member is completely positioned in the inner space of the door in a compressed state. In the compressed state, the elastic member has a resilience that, when the external force is removed from the button tray 210, causes the elastic member to return to an original or uncompressed state while pushing the button tray 210 in a direction outside of the inner space of the door.

The food storage apparatus further may include a guide unit for guiding residual content such that the residual content is received in the button tray composite device 200.

Referring to FIGS. 7 to 10, the guide unit 140 of the food storage apparatus guides residual contents to the button tray 210.

In some examples, the guide unit 140 is disposed above the button tray 210 when the food storing apparatus is oriented in an ordinary operating position. In these examples, the guide unit 140, disposed above the button tray 210, serves to guide the residual contents, such as water or ice, falling from the moving chute 120 or the water discharge duct, to the button tray 210.

Specifically, the guide unit 140 may be disposed between the dispenser 100 and the button tray 210 in a space defined in the door between the front frame 61 and the rear frame 63. When the moving chute 120 and the water discharge duct are received in the inner space of the door defined between the front frame 61 and the rear frame 63, the guide unit 140 serves to guide residual content falling from the moving chute 120 to the button tray 210.

The guide unit may have a cross-sectional surface area that is larger than a cross-sectional surface area of the moving chute 120 and/or a cross-sectional surface area of the water discharge duct. In some examples, an end of the moving chute 120 and/or the water discharge duct includes an inner edge that defines an opening through which content discharged out of the moving chute 120 and/or the water discharge duct passes and an outer edge that defines an exterior of the end of the moving chute 120 and/or the water discharge duct. In these examples, when the appliance is oriented in an ordinary operating position, the guide unit may be positioned beneath the opening defined by the inner edge of the end of the dispenser outlet and extend beyond at least a portion the outer edge of the end of the dispenser outlet.

In some implementations, the guide unit 140 is inclined toward the button tray 210 such that the residual contents are guided to the button tray 210. When the residual contents falling from the moving chute 120 and the water discharge duct are delivered to the guide unit 140, the residual contents are guided toward the button tray 210 along the inclined portion of the guide unit 140. The residual contents are guided toward the button tray 210 along the inclined portion of the guide unit 140 based exclusively on gravitational force.

In some examples, the guide unit 140 may include communication holes 152, to which the button tray 210 of the above-described button tray composite device 200, the tray drive mechanism, and the controller are connected. The communication holes 152 may be formed in various shapes depending upon the connection structure of the dispenser and the button tray composite device 200.

When the communication holes 152 are provided, to the guide unit 140 also may include protrusions 153 that prevent the residual contents, guided by the guide unit 140, from falling to other regions through the communication holes 152. The protrusions 153 extend along the edges of the corresponding communication holes 152 while the protrusions 153 extend upward by a predetermined length. The protrusions 153 serve to prevent the residual contents from falling out of the communication holes 152, during the guidance of the residual contents on the guide unit 140.

The guide unit 140 may be provided, above the button tray 210, with a first collection part 154 that allows the residual contents guided by the guide unit 140 to fall to the button tray 210 therethrough.

Figure 7:
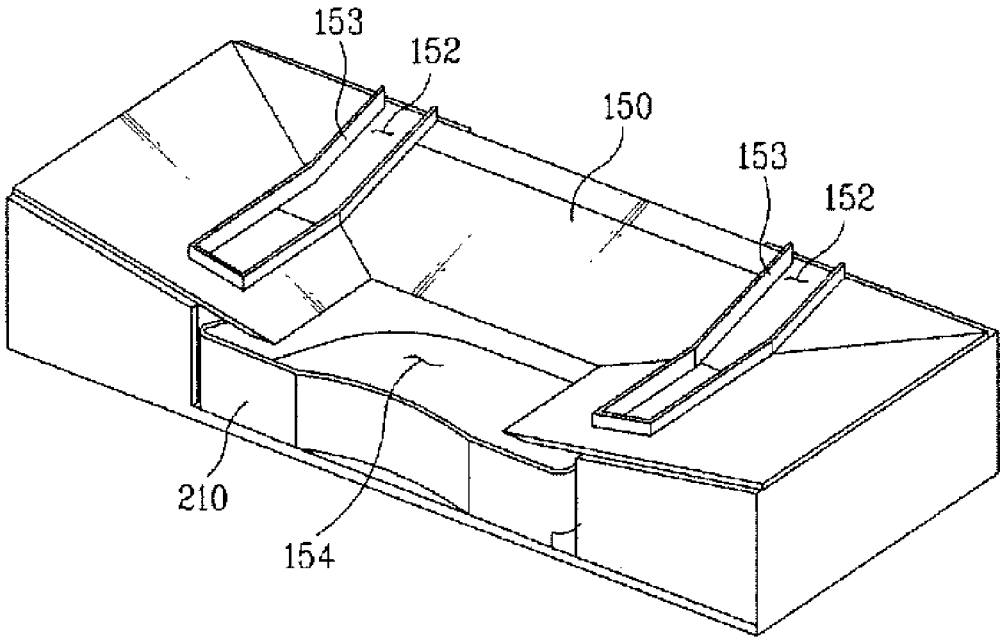
FIG. 7 is a perspective view illustrating a first guide member.

The first connection part 154 may be in the shape of a hole and positioned in the middle of the guide unit 140. Alternatively, the first connection part 154 may be formed by cutting one side of the guide unit as shown in FIG. 7. In this case, the incline formed at the guide unit 140 may be directed to the first connection part 154.

The guide unit 140 may be fixed in the inner space of the door such that the guide unit 140 is positioned at a position where the button tray 210 is received in the inner space of the door irrespective of whether or not the moving chute 120, the dispensing cover 110, and the button tray 210 are also received in the inner space of the door.

In this example, the guide unit 140 may serve to guide the residual contents, that continue to fall from the moving chute 120 after the moving chute 120 and the water discharge duct are retracted to the inside of the door, to the button tray 210. The guide unit 140 also may serve to guide moisture, condensed in the dispenser 100, to the button tray 210, when the moisture falls from the moving chute 120 or another part of the dispenser.

In further implementations, the guide unit 140 may be integrated with the moving chute 120 or the dispensing cover 110. In these implementations, when the moving chute 120 and the dispensing cover 110 are positioned outside of the door, the guide unit 140 also is positioned outside of the door together with the moving chute 120 and the dispensing cover 110. When the guide unit 140 is positioned outside of the door, the guide unit 140 prevents the contents, discharged from the moving chute 120 and the water discharge duct, from splashing or falling to the floor and guides the contents to the button tray 210, which is also positioned outside of the door.

Also, when the moving chute 120 and the dispensing cover 110 are retracted to the inside of the door, the guide unit 140 serves to guide residual contents to the button tray 210 when the moving chute 120 and the dispensing cover 110 are in a stored position.

Figure 8:
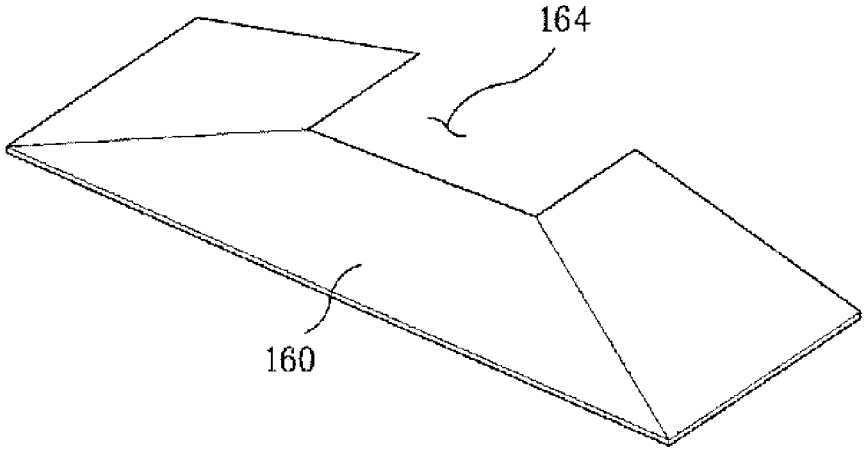
FIG. 8 is a perspective view illustrating a second guide member.
Figure 9:
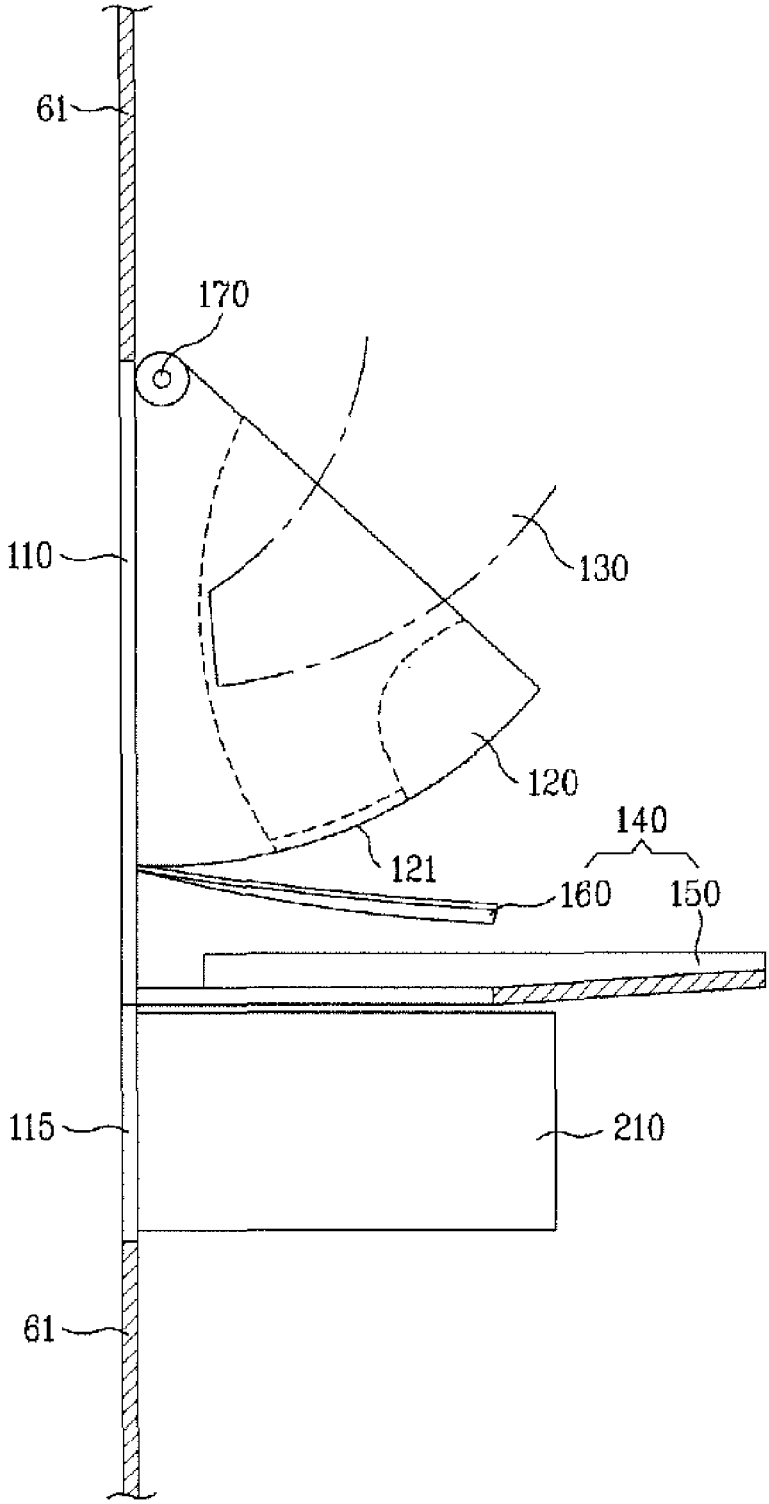
FIG. 9 is a side view illustrating a state in which a button tray and a guide unit are in a stored position retracted inside of a door.
Figure 10:
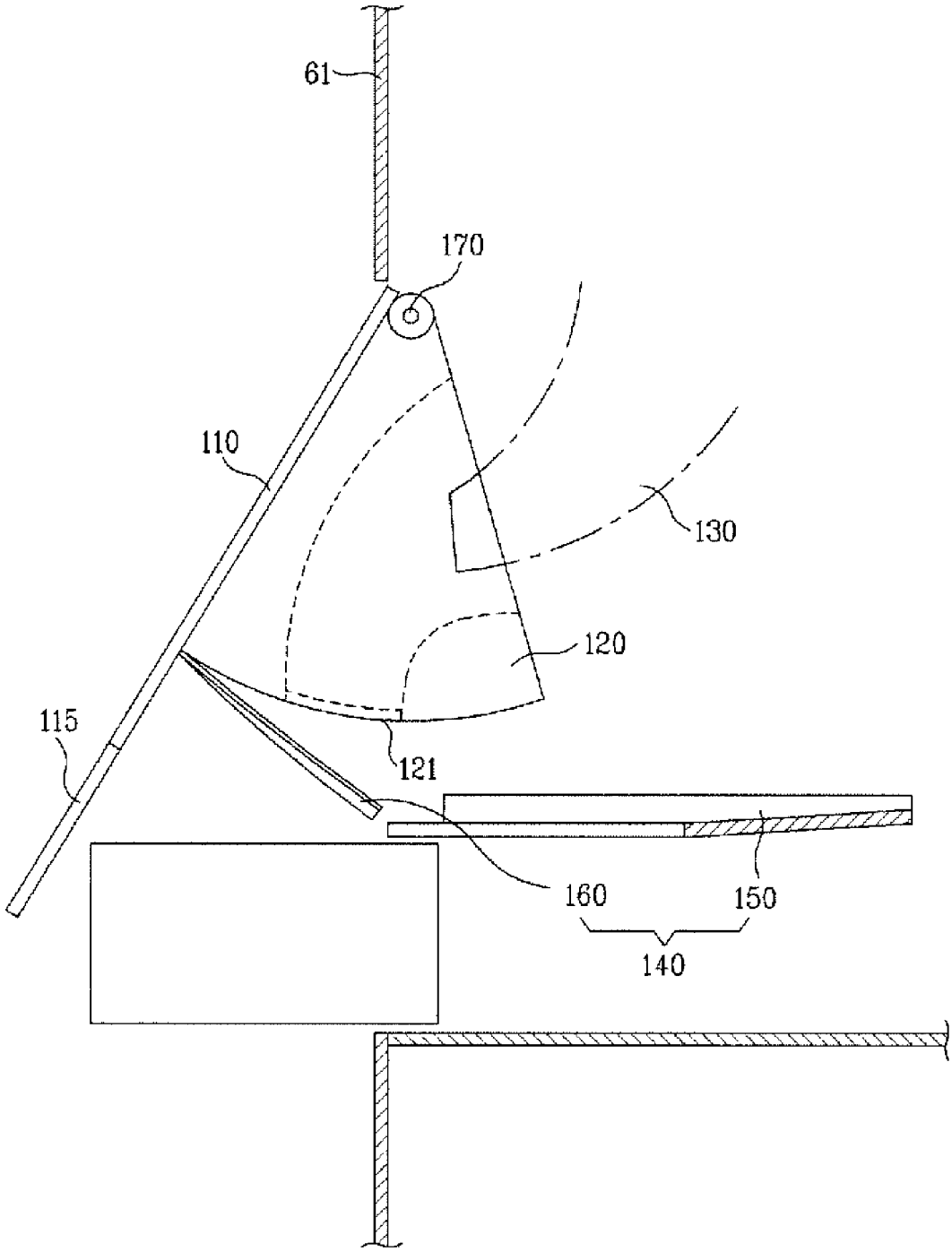
FIG. 10 is a side view illustrating a state in which the button tray and the guide unit are in an operable position outside of the door.

Referring to FIG. 8, a second collection part 164 may be formed at the guide unit 140, which is integrated with the moving chute 120 or the dispensing cover 110. The second collection part 164 is located above the button tray 210 not only when the moving chute 120, the dispensing cover 110, and the button tray 210 are positioned outside of the door, but also when the moving chute 120, the dispensing cover 110, and the button tray 210 are retracted to the inside of the door. This result may be achieved because the guide unit 140 is constructed such that the guide unit 140 may be moved to a position outside of the door together with the moving chute 120, the dispensing cover 110, and the button tray 210 and also may be retracted to the inside of the door together with the moving chute 120, the dispensing cover 110, and the button tray 210.

When the moving chute 120 and the water discharge duct are positioned outside of the door to discharge water and ice, the second collection part 164 serves as a channel through which the water and the ice falls into the container. The contents, splashing or falling, also falls into the container through the second collection hole 164 by the guidance of the guide unit 140.

Also, when the moving chute 120 and the water discharge duct are retracted to the inside of the door, the residual contents or the condensed moisture is guided by the guide unit 140, falls through the second collection part 164, and is then received in the button tray 210.

Furthermore, the guide unit 140 may include a first guide member 150 that is disposed above the button tray 210 and that is fixed to the front frame 61. When the button tray 210 is retracted to the inside of the front frame 61, the first guide member 150 guides the residual contents to the button tray 210. The guide unit 140 also may include a second guide member 160 integrated with the moving chute 120 or the dispensing cover 110 that guides the residual contents to the button tray 210 when the moving chute 120 is positioned outside of the door.

That is, the guide unit 140 of the food storage apparatus may constructed in a structure in which the guide unit 140 is fixed to the inside of the door or in a structure in which the guide unit 140 is integrated with the moving chute 120 or the dispensing cover 110.

The first guide member 150 may be fixedly disposed above the button tray 210 and configured to guide the residual contents, such as water, ice, or the like, falling from the moving chute 120 or the water discharge duct (not shown), to the button tray 210.

As previously described, the first guide member 150 is may be inclined toward the button tray 210 such that the first guide member 150 guides the residual contents to the button tray 210. Also, the first guide member 150 may include communication holes 152, to which the button tray 210 of the above-described button tray composite device 200, the tray drive mechanism, and the controller are connected.

When the communication holes 152 are provided, protrusions 153 may be provided to prevent the residual contents, guided by the first guide member 150, from falling to other regions through the communication holes 152.

The first guide member 150 is provided, above the button tray 210, with a first collection part 154 for allowing the residual contents, guided by the first guide member 150, to fall to the button tray 210 therethrough.

The second guide member 160 may be integrated with the moving chute 120 or the dispensing cover 110. In this configuration, when the moving chute 120 and the dispensing cover 110 moved outside of the door, the second guide member 160 is also moved outside of the door together with the moving chute 120 and the dispensing cover 110 to prevent the contents, discharged from the moving chute 120 and the water discharge duct, from splashing or falling to the floor and to guide the contents to the button tray 210, which is also moved outside of the door.

The second collection part 164 may be provided at the second guide member 160, which is integrated with the moving chute 120 or the dispensing cover 110. The second collection part 164 may be located above the button tray 210 when the moving chute 120, the dispensing cover 110, and the button tray 210 are positioned outside of the door, but also when the moving chute 120, the dispensing cover 110, and the button tray 210 are retracted to the inside of the door.

When the moving chute 120 and the water discharge duct are positioned outside of the door to discharge water and ice, the second collection part 164 serves as a channel through which the water and the ice falls into a container. The contents, splashing or falling, also falls into the container through the second collection hole 164 by the guidance of the guide unit 140.

When the moving chute 120 is positioned inside of the front frame 61, the second guide member 160 is positioned to guide the residual contents to the first guide member 150. Specifically, the residual contents, falling from the moving chute 120 or the water discharge duct, are guided by the second guide member 160, and then fall onto the first guide member 150. The residual contents, falling onto the first guide member 150, flow along the first guide member 150. As a result, the residual contents are guided into the button tray 210.

In some implementations, the guide unit may be constructed such that the residual contents, falling through the second collection part 164 of the second guide member 160, fall directly into the button tray 210. However, the guide unit may be constructed such that the residual contents are sequentially guided by the second guide member 160 and the first guide member 150, as described above, to prevent the residual contents from splashing out of the button tray 210 with the increase of the falling distance.

The operation of the button tray composite device will be described below with reference to FIGS. 2 to 10.

When a user wishes to dispense content, e.g., ice or water, he/she presses the lower end of the dispensing cover 110. For instance, the user presses the portion of the dispensing cover 110 that corresponds to a position where the couplers 181 and 183 that couple the dispensing cover 110 to the front frame 61 are arranged.

In response to the user pressing the portion of the dispensing cover 110, the dispensing cover 110 and button tray 210 simultaneously move outward from the front frame 61. Specifically, the dispensing cover 110 is protruded outwardly of the front frame 61 by the resilience of the elastic device mounted to the moving chute drive mechanism, and the button tray 210 is protruded outwardly of the front frame 61 by the resilience of the elastic member included in the tray drive mechanism, e.g., the wire spring 240. The second guide member 160, integrated with the dispensing cover 110, also is protruded outwardly from the front frame 61.

When the user subsequently brings a container into contact with the button tray 210, and pushes the button tray 210 in a direction into the door with the container, the moving member 220, coupled to the button tray 210, is moved in the direction into the door along the guide member 250, together with the button tray 210.

During the movement of the moving member 220, the wire spring 240 is unwound from the roller 230 in accordance with the movement of the moving member 220.

When the moving member 220 reaches a predetermined position, the button switch 280, mounted to the button tray 210, contacts or connects with the dispensing switch 270 arranged in the interior of the door. In response to a signal generated in response to the connection between the button switch 280 and the dispensing switch 270, the controller performs a control operation to dispense content (e.g., ice or water) through the outlet 121. The contents fall into the container through the second collection part 164 of the second guide member 160. That is, the second guide member 160 serves to prevent the contents from splashing in other directions and thus falling to the floor. The second guide member 160 guides the content in a direction such that the content would fall, through the second collection part 164, into a container pushing the button tray 210.

In this example, the controller controls dispensing of content in such a manner that the contents are dispensed through the outlet 121 only when the moving chute 120 is in an operable position (e.g., rotated outside of the front frame 61). That is, the contents are not dispensed when the moving chute 120 and button tray 210 are arranged in the interior of the door, even if the button switch 280 mounted to the button tray 210 contacts or connects with the dispensing switch 270.

The signal may be generated, based on information including the contact time of the connection between the button switch 280 and the dispensing switch 270 or the contact position. For instance, content may be dispensed as long as the connection between the button switch 280 and the dispensing switch 270 remains. In some examples, dispensing of content does not begin until the connection between the button switch 280 and the dispensing switch 270 has existed for a threshold period of time (e.g., one second). In these examples, dispensing of content is delayed for the threshold period of time, which may avoid content from being dispensed as a result of an inadvertent movement of the button tray 210.

In other examples, the dispensing of content does not begin until the button switch 280 contacts the dispensing switch 270 at a particular portion of the dispensing switch 270. For example, dispensing of content may not occur until the button switch 280 contacts a rear portion of the dispensing switch 270 positioned further into the door. In this example, dispensing of content occurs for relatively large movement of the button tray 210, but does not occur for relatively small movement of the button tray 210, which may avoid content from being dispensed as a result of an inadvertent movement of the button tray 210.

An amount or a rate of content being dispensed by the dispenser also may be controlled using the button tray 210. For example, depending on the position of the button tray 210, the dispensing of content may be regulated from among at least three settings (e.g., an off setting, a fully on setting, and a partially on setting). In this example, no movement of the button tray 210 may result in a first setting in which content is not dispensed, a relatively small movement of the button tray 210 may result in a second setting in which content is dispensed at a first rate, and a relatively large movement of the button tray 210 may result in a third setting in which content is dispensed at a second rate that is different than the first rate. The second rate may be larger than the first rate and allow a container to be filled more quickly in response to a relatively large movement of the button tray.

When the user releases the container, in which the contents have been received, from the button tray 210 after a dispensing operation, the moving member 220 and button tray 210 move, by the resilience of the wire spring 240, to original positions thereof (e.g., positions prior to the movement caused by user application of force with the container in performing the dispensing operation). The original position may be a position beneath the outlet 121.

When the button tray 210 is returned to the original position beneath the outlet 121, the residual contents discharged out of the outlet 121 just after the dispensation of the contents is received and contained in the button tray 210. Accordingly, the residual contents are not dropped onto the floor. The second guide member 160 serves to guide the contents to the button tray 210 such that the contents may be dropped only into the button tray 210.

In other words, the button tray 210 moves from a position in which the button tray 210 is misaligned with the outlet 121 to a position in which the button tray 210 is aligned with the outlet 121. In the misaligned position, the button tray 210 is not configured to receive content discharged from the outlet 121. However, in the aligned position, the button tray 210 is configured to receive content discharged from the outlet 121. By moving the button tray 210 from the misaligned position to the aligned position after dispensing of content (e.g., as or after a user removes force supplied with a container to the button tray 210), the button tray 210 may receive residual content dispensed through the outlet 121 in the aligned position. In the aligned position otherwise unguided content dispensed for the outlet 121 falls into the button tray 210 in an ordinary operating orientation and use of the food storing apparatus/refrigerator, and in the misaligned position otherwise unguided content dispensed for the outlet 121 falls into the button tray 210 in an ordinary operating orientation and use of the food storing apparatus/refrigerator.

Movement of the button tray 210 may follow a path different from the path of the button tray 210 described above. As described above, the button tray 210 retracts and extends toward and away from a surface of the door in a plane perpendicular to the door surface. In some implementations, the button tray 210 also may rotate or pivot toward and away from the door surface about a pivot point or extend and retract in a plane that is not perpendicular to the door surface.

When the user subsequently pushes the dispensing cover 110 in a direction into the door, the moving chute 120 and button tray 210 are inserted into the inner space of the door. In this stored position, the button tray 210 may receive the residual contents, which may be discharged out of the outlet 121, because the button tray 210 may remain positioned beneath the outlet 121.

Thus, the button tray 210 may reliably receive residual contents that occur after a dispensing operation because the button tray 210 may always be positioned beneath the outlet 121 (or in another position in which the button tray 210 receives content dispensed from the outlet 121), irrespective of whether the button tray 210 is in an operable position protruded outwardly of the front frame 61 or in a closed position inserted into the inner space of the door.

The second guide member 160 and the first guide member 150 serve to guide the residual contents to the button tray 210 in the operable and closed positions.

The second guide member 160 is positioned to guide the residual contents to the first guide member 150 when the moving chute 120 is retracted to the inside of the front frame 61. Specifically, the residual contents, falling from the moving chute 120 or the water discharge duct, are guided by the second guide member 160, and then fall onto the first guide member 150. The residual contents, falling onto the first guide member 150, flow along the first guide member 150. As a result, the residual contents are guided into the button tray 210.

In the above description, the operation of food storage apparatus was illustrated in connection with an example in which the first guide member 150 and the second guide member 160 are separately provided. However, the guide unit 140 may be constructed such that the guide unit 140 is provided, in a fixed or integrated fashion, to guide the residual contents to the button tray 210.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

As apparent from the above description, a food storage apparatus described above may have the following effects.

First, residual contents, additionally discharged through an outlet after dispensing, may be prevented from being dropped onto the floor, in accordance with the provision of the button tray composite device, which not only functions as a button enabling dispensing of content, but also functions as a tray receiving the residual contents. In particular, a tray drive mechanism, which is included in the button tray composite device, moves the button tray toward an outlet from which residual contents are discharged after dispensing of content dispensation to allow the button tray to receive the residual contents. Also, the residual contents may not fall to the floor, but may instead be received in the button tray, by the provision of a guide unit that guides residual contents to the button tray. The button tray composite device may be conveniently used in any case, irrespective of the position of the outlet, from which the contents are discharged. For example, the button tray composite device may be used in the case in which the outlet is tilted out of the interior of the door, the case in which the outlet is attached to a front surface of the door, and the case in which the outlet is arranged in the recess formed at the door.

The button tray composite device may receive residual contents, not only in a state in which the moving chute is positioned outside of the door, but also in a state in which the moving chute is inserted into the interior of the door. A guide unit may enhance the ability of the button tray composite device to receive residual content. In addition, the guide unit may enable button tray composite device to capture residual contents discharged to other regions in the inner space of the door.

The thickness of the door may be reduced, in particular, in a region where the dispenser is installed, and thus, the inner space of the food storage apparatus may be increased by configuring the dispenser such that the outlet of the moving chute, which dispenses ice or water, or the outlet of the water discharge duct is moved outside of the front surface of the door of the food storage apparatus when the dispenser is used, and is inserted into the interior of the door when the dispenser is not used.

The dispensing cover may be prevented from coming into contact with the button tray when the moving chute is inserted into the inner space of the door, by the provision of the tray holder that moves the button tray, simultaneously with insertion movement of the moving chute.

The food storage apparatus may include a dispenser, which is moved to a position outside of the door, during dispensing of contents, and is retracted to the inside of the door, after dispensing of contents. A button tray composite device may be moved to a position outside of the door and retracted to the inside of the door together with the dispenser, and a guide unit may guide residual contents to the button tray composite device such that the residual contents are received in the button tray composite device.

What is claimed is:

1. An appliance comprising:

a compartment;

a door configured to open and close at least a portion of the compartment;

a dispenser that is positioned on a surface of the door and that is configured to dispense content through a dispenser outlet;

a button tray composite device that is configured to control the dispenser to dispense content and that is configured to receive residual content discharged out of the dispenser outlet after the dispenser dispenses content; and a guide unit that is configured to capture and guide residual content discharged out of the dispenser outlet to the button tray composite device such that the residual content is received and stored in the button tray composite device, the guide unit being positioned between the dispenser outlet and the button tray composite device and being structurally independent of at least the dispenser outlet, wherein the dispenser includes a moving chute that is configured to move between an operable position in which the moving chute is at least partially positioned on a side of the surface of the door opposite of the compartment, and a stored position in which the moving chute is positioned entirely on a side of the surface of the door where the compartment is positioned, the moving chute having structure that defines at least a portion of a passage through which content is discharged from the appliance, and wherein the button tray composite device includes a button switch configured to control the dispenser to dispense content.

2. The appliance according to claim 1 wherein the guide unit has a cross-sectional surface area that is larger than a cross-sectional surface area of the dispenser outlet.

3. The appliance according to claim 1, wherein an end of the dispenser outlet includes an inner edge that defines an opening through which content discharged out of the dispenser outlet passes and an outer edge that defines an exterior of the end of the dispenser outlet, and when the appliance is oriented in an ordinary operating position, the guide unit is positioned beneath the opening defined by the inner edge of the end of the dispenser outlet and extends beyond at least a portion of the outer edge of the end of the dispenser outlet.

4. The appliance according to claim 1,
wherein the guide unit includes:
a first guide member that is disposed above the button tray when the appliance is oriented in an ordinary operating position, that is fixed to a frame of the door, and that is configured to guide the residual content to the button tray when the button tray is positioned entirely on a side of the surface of the door where the compartment is positioned; and
a second guide member that is configured to move with the moving chute relative to the first guide member and that is configured to guide residual content to the button tray when the button tray is in a position in which at least a portion of the button tray is positioned on the side of the door surface opposite of the compartment.

5. The appliance according to claim 4, wherein the second guide member is positioned to guide the residual content to the first guide member when the moving chute is positioned entirely on a side of the surface of the door where the compartment is positioned.

6. The appliance according to claim 1, wherein
the button tray composite device further includes a button tray defining a content receiving space for receiving and storing the residual content, and a tray drive mechanism configured to move the button tray away from the door surface in the absence of external force applied to the button tray in a direction that is toward the door surface, and to change a position of the button tray from a first position that is misaligned with the dispenser outlet in response to force that is applied to the button tray to a receiving position that is aligned with and captures content dispensed through the dispenser outlet in response to removal of force that is applied to promote positioning of the button tray to the first position, and
the guide unit is configured to guide residual content to the button tray.

7. The appliance according to claim 6, further comprising:
a dispensing switch that is positioned to contact the button switch in response to movement of the button tray, and that is configured to control the dispenser to dispense content through the dispenser outlet in response to being contacted by the button switch.

8. The appliance according to claim 6, wherein the button tray of the button tray composite device is configured to move to a position in which at least a portion of the button tray is positioned on the side of the door surface opposite of the compartment when the moving chute moves from the stored position to the operable position.

9. The appliance according to claim 8, wherein the dispenser includes
a dispensing cover arranged further from the compartment than the moving chute, and
a cover fixing unit that is configured to, when the moving chute is positioned in the operable position, prevent the dispensing cover from being moved by a force lower than a predetermined force, and to allow the moving chute to move from the operable position toward the stored position in response to a force higher than the predetermined force.

10. The appliance according to claim 9, wherein the guide unit is attached to the moving chute or the dispensing cover.

11. The appliance according to claim 6, wherein the guide unit is disposed above the button tray when the appliance is oriented in an ordinary operating position.

12. The appliance according to claim 11, wherein the guide unit includes an inclined portion that is inclined toward the button tray, the inclined portion being configured to capture residual content discharged from the dispenser outlet and guide the captured residual content to the button tray based on gravitational force.

13. The appliance according to claim 6, wherein the guide unit is positioned on a side of the surface of the door where the compartment is positioned.

14. An appliance comprising:
a compartment;
a door configured to open and close at least a portion of the compartment;
a dispenser that is positioned on a surface of the door and that is configured to dispense at least one of liquid water and ice through a dispenser outlet;
a button tray configured to inspire at least one of liquid water and ice to be dispensed from the dispenser in response to being pushed and to, after release of force pushing the button tray to inspire at least one of liquid water and ice to be dispensed from the dispenser, receive and store at least one of residual liquid water and residual ice dispensed from the dispenser;
a button switch attached to the button tray and configured to control the dispenser to dispense at least one of liquid water and ice in response to the button tray being pushed; and
a guide unit that is configured to guide at least one of residual liquid water and residual ice discharged out of the dispenser outlet to the button tray such that the at least one of residual liquid water and residual ice is received and stored in the button tray,
wherein the dispenser includes a moving chute that is configured to move between an operable position in which the moving chute is at least partially positioned on a side of the surface of the door opposite of the compartment, and a stored position in which the moving chute is positioned entirely on a side of the surface of the door where the compartment is positioned, the moving chute having structure that defines at least a portion of a passage through which content is discharged from the appliance.

15. The appliance according to claim 14 wherein the guide unit has a cross-sectional surface area that is larger than a cross-sectional surface area of the dispenser outlet.

16. The appliance according to claim 14,
wherein the guide unit includes:
a first guide member that is disposed above the button tray when the appliance is oriented in an ordinary operating position, that is fixed to a frame of the door, and that is configured to guide the residual liquid water and ice to the button tray when the button tray is positioned entirely on a side of the surface of the door where the compartment is positioned, and
a second guide member that is configured to move with the moving chute relative to the first guide member and that is configured to guide residual liquid water and ice to the button tray when the button tray is in a position in which at least a portion of the button tray is positioned on the side of the door surface opposite of the compartment.

17. The appliance according to claim 16, wherein the second guide member is further configured to guide residual content to the first guide member when the moving chute is in the stored position.

18. The appliance according to claim 14, wherein the dispenser includes
a dispensing cover arranged further from the compartment than the moving chute, and
a cover fixing unit that is configured to, when the moving chute is positioned in the operable position, prevent the dispensing cover from being moved by a force lower than a predetermined force, and to allow the moving chute to move from the operable position toward the stored position in response to a force higher than the predetermined force.

19. The appliance according to claim 14, wherein the guide unit is disposed above the button tray when the appliance is oriented in an ordinary operating position.

20. The appliance according to claim 14, wherein the guide unit includes an inclined portion that is inclined toward the button tray, the inclined portion being configured to capture residual content discharged from the dispenser outlet and guide the captured residual content to the button tray based on gravitational force.

21. An appliance comprising:

a compartment;

a door configured to open and close at least a portion of the compartment;

a dispenser that is positioned on a surface of the door and that is configured to dispense content through a dispenser outlet;

a button tray composite device that is configured to control the dispenser to dispense content and that is configured to receive residual content discharged out of the dispenser outlet after the dispenser dispenses content, wherein the button tray composite device further includes a button tray defining a content receiving space for receiving and storing the residual content, and a tray drive mechanism configured to move the button tray away from the door surface in the absence of external force applied to the button tray in a direction that is toward the door surface, and to change a position of the button tray from a first position that is misaligned with the dispenser outlet in response to force that is applied to the button tray to a receiving position that is aligned with and captures content dispensed through the dispenser outlet in response to removal of force that is applied to promote positioning of the button tray to the first position; and a guide unit that is configured to capture and guide residual content discharged out of the dispenser outlet to the button tray composite device such that the residual content is received and stored in the button tray composite device, the guide unit being positioned between the dispenser outlet and the button tray composite device and being structurally independent of at least the dispenser outlet, the guide unit configured to guide residual content to the button tray, wherein the guide unit is positioned on a side of the surface of the door where the compartment is positioned.

* * * * *